US012286908B2

(12) United States Patent
Stretch

(10) Patent No.: US 12,286,908 B2
(45) Date of Patent: Apr. 29, 2025

(54) VALVETRAIN POWER TRANSFER MODULE WITH SHORTENED LEAF-SPRING CONTACT

(71) Applicant: Eaton Intelligent Power Limited, Dublin (IE)

(72) Inventor: Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/611,957

(22) PCT Filed: May 15, 2020

(86) PCT No.: PCT/EP2020/025226

§ 371 (c)(1),
(2) Date: Nov. 17, 2021

(87) PCT Pub. No.: WO2020/233835

PCT Pub. Date: Nov. 26, 2020

(65) Prior Publication Data

US 2022/0235677 A1 Jul. 28, 2022

Related U.S. Application Data

(60) Provisional application No. 62/849,447, filed on May 17, 2019.

(51) Int. Cl.
*F01L 1/18* (2006.01)
*F01L 1/047* (2006.01)
(Continued)

(52) U.S. Cl.
CPC ..... *F01L 1/185* (2013.01); *F01L 1/047* (2013.01); *F01L 1/181* (2013.01); *F01L 1/46* (2013.01);
(Continued)

(58) Field of Classification Search
CPC ..... F01L 1/46; F01L 9/26; F01L 2013/001; F01L 13/0005; F01L 13/0036;
(Continued)

(56) References Cited

U.S. PATENT DOCUMENTS

2004/0035381 A1 2/2004 Burch
2017/0183982 A1* 6/2017 Hughes ..... F01L 1/267
(Continued)

FOREIGN PATENT DOCUMENTS

CN 2927350 Y 7/2007
CN 102032053 A 4/2011
(Continued)

OTHER PUBLICATIONS

International Search Report and Written Opinion for International Application No. PCT/EP2020/025226 mailed on Aug. 19, 2020, 14 pages.
(Continued)

*Primary Examiner* — Wesley G Harris
(74) *Attorney, Agent, or Firm* — Baker Botts L.L.P.

(57) ABSTRACT

A valvetrain includes a camshaft (501), a pivot (303), a rocker arm assembly (203) mounted on the pivot (303), a latch assembly (122), a power transfer module (100) a rocker arm (401), a cam follower (301) configured to engage a cam, and two contacts pin (403) protruding to opposite sides of the rocker arm (401). The electromagnetic latch assembly (122) includes a latch pin (405) and an electromagnet (119) that is powered through at least one of the contact pins (403). The power transfer module (100) includes a framework (101) that supports two contact pad each contacting a respective one of the contact pins. The framework (101) has a base that abuts the pivot (303). The
(Continued)

contact pads extend upward from the base and terminates at a height that is below a height of the rocker arm assembly (203) above the pivot (303).

20 Claims, 7 Drawing Sheets

(51) Int. Cl.
*F01L 1/46* (2006.01)
*F01L 9/26* (2021.01)
*F01L 13/00* (2006.01)

(52) U.S. Cl.
CPC ..... *F01L 9/26* (2021.01); *F01L 13/0005* (2013.01); *F01L 13/0036* (2013.01); *F01L 2001/186* (2013.01); *F01L 2013/001* (2013.01); *F01L 2013/101* (2013.01)

(58) Field of Classification Search
CPC ..... F01L 1/185; F01L 2001/186; F01L 2013/101; F01L 9/20; F01L 2201/00; F01L 2001/187
See application file for complete search history.

(56) References Cited

U.S. PATENT DOCUMENTS

2017/0241300 A1* 8/2017 Liskar ..... F01L 1/185
2018/0142583 A1* 5/2018 Liskar ..... F01L 1/185
2018/0195419 A1 7/2018 Liskar
2018/0238198 A1 8/2018 Uckermark

FOREIGN PATENT DOCUMENTS

CN 109072727 A 12/2018
DE 102005036918 A1 * 2/2007 ..... F01L 1/185
DE 102010018712 A1 * 11/2011 ..... F01L 1/053
EP 1408203 A2 4/2004
JP H0861030 A 3/1996
WO WO 2016028812 A1 2/2016
WO WO-2017091799 A1 * 6/2017 ..... F01L 1/053
WO WO-2018075392 A1 * 4/2018 ..... F01L 1/18
WO WO-2018208857 A1 * 11/2018 ..... F01L 1/053

OTHER PUBLICATIONS

CN OA for Chinese Application No. 202080040832.X, 16 pages, Jun. 20, 2023.
Pu et al., Optimization of Cam and Rocker Arm of Engine Valve Train, Journal of Shanghai Jiao Tong University, Feb. 2009, vol. 43:(2), p. 275-278, Feb. 2009.

* cited by examiner

VALVETRAIN POWER TRANSFER MODULE WITH SHORTENED LEAF-SPRING CONTACT

PRIORITY

This application is a U.S. National Phase application under 35 U.S.C. § 371 of International Application No. PCT/EP2020/025226, filed on 15 May 2020, which claims the benefit under 35 U.S.C. § 119(e) of U.S. Provisional Patent Application No. 62/849,447, filed 17 May 2019.

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems, each rocker arm assembly has two hydraulic feeds, which entails a degree of complexity and equipment cost.

The oil demands of these hydraulic feeds may approach the limits of existing supply systems. The complexity and demands for oil in some valvetrain systems can be reduced by replacing hydraulically latched rocker arm assemblies with electrically latched rocker arm assemblies. Electrically latched rocker arm assemblies require power. There is an ongoing need for reliable structures for power transfer to the rocker arm assembly.

SUMMARY

The present teachings relate to powering an electrical device that is mounted to a mobile portion of a rocker arm assembly such as a rocker arm. The electrical device may be an electromagnet of an electromagnetic latch assembly. If the electrical device is powered with conventional wiring, it is a possible for a wire to be caught, clipped, or fatigued and consequently short out. The present teachings provide a valvetrain suitable for an internal combustion engine that includes a combustion chamber, a moveable valve having a seat formed within the combustion chamber, and a camshaft. The valvetrain includes a camshaft and a rocker arm assembly. The rocker arm assembly includes a rocker arm, a cam follower configured to engage a cam mounted on the camshaft as the camshaft rotates, and an electrical device mounted to the rocker arm. The rocker arm assembly may rest on a pivot that is supported by a cylinder head of the engine.

An electrical circuit that powers the electrical device includes a connection formed by abutment between the surfaces of two distinct parts. One of those parts is a contact pin that is mounted to a rocker arm of the rocker arm assembly. The other part is a contact pad held by the framework of a power transfer module. The power transfer module may include a wiring harness. The contact pad may be a leaf spring. Preferably, the contact pin is one of a pair on either side of the rocker arm. Having two contact pins abutted by leaf springs on opposite sides of the rocker arm tends to balance the forces placed on the rocker arm by the contact pins and leaf springs.

According to some aspects of the present teachings, the contact pads have protrusions toward the rocker arm assembly in an area above the contact pins. The protrusions are operative together with the contact pins to improve retention of the rocker arm assembly on the pivot. The protrusions may be bulges on the contact pad surfaces. The contact pads may be sheet metal. In some of these teaching, the protrusions are formed by rolls in the contact pads that form inward-facing lips. In some of these teachings, the contact pads are leaf springs. In some of these teachings, the contact pads have resiliency that biases the contact pads against the contact pins. The contact pads may be connected to metal leads and the framework that supports the contact pads may contain the metal leads. In some of these teachings, the framework abuts a pivot for the rocker arm assembly. In some of these teachings, the framework fits around the pivot. In some of these teachings, the framework fits around a plurality of pivots associates with a plurality of rocker arm assemblies.

Some aspects of the present teachings relate to a valvetrain for an internal combustion engine of a type that has a combustion chamber and a moveable valve having a seat formed in the combustion chamber. The valvetrain includes a camshaft, a pivot, a rocker arm assembly mounted on the pivot, a latch assembly, and a power transfer module. The rocker arm assembly includes a rocker arm, a cam follower configured to engage a cam mounted on the camshaft as the camshaft rotates, and two contacts pin protruding to opposite sides of the rocker arm assembly. The electromagnetic latch assembly is mounted on the rocker arm assembly and includes a latch pin and an electromagnet that is powered through at least one of the contact pins. The electromagnet is operable to move the latch pin between a first latch pin position and a second latch pin position. The power transfer module includes a framework that supports two contact pad each contacting a respective one of the contact pins. The framework has a base that abuts the pivot. The contact pads extend upward from the base and terminate at a height that is below a height of the rocker arm assembly above the pivot. In some of these teachings, the contact pads extend upwards 20 mm or less. The shortened contact pads that extend upward from the base provide a better package design than longer contact pads or contact pads that are held at the top as well as at the bottom. The design allows the rocker arms to be installed by lowering them onto the pivots after the framework has been placed on the cylinder head. The framework may fit around the pivot and be held in position by the pivot.

In some of these teachings the electromagnetic latch assembly provides the latch pin with positional stability independently from the electromagnet when the latch pin is in the first position and when the latch pin is in the second position. In some of these teachings, that stability is provided by one or more permanent magnets. In some of these teachings, the electromagnetic latch assembly is operable with a DC current in a first direction to actuate the latch pin from the first position to the second positions and with a DC current in a second direction, which is a reverse of the first, to actuate the latch pin from the second position to the first position. Having the electromagnetic latch assembly make the latch pin stable without power in both the first and the second positions allows the electrical connection to be broken without the latch pin position changing. Moreover, the bi-stable latch allows operation of the electromagnet to be restricted to times at which the cam is on base circle and the contact pins are stationary relative to the contact pads. It has been found that restricting current flow to times at which the contacting surfaces are stationary relative to one another reduces wear on the contacting surfaces.

In some of these teachings, the contact pads angle outward from the rocker arm assembly as they extend upward from the base. Having the contact pads angle outward minimizing the possibility of the rocker arm assembly rocking to one or the other side to strike one of the contact pads. Consistent with this alternative, inward bulges may still be formed in the contact pads above the contact pins. In a method according to the present teachings, the rocker arm assembly is installed on the pivot by deforming the contact pads outward to get the contact pins past the inward bulges.

The rocker arm assembly has a front end and a back end. The front end is the end proximate to which the rocker arm assembly abuts a valve stem. The back end is proximate the one to which the rocker arm assembly rests on the pivot. The pivot may have a dome-shaped upper surface and the rocker arm may have a gothic profile formed in its bottom surface to interface with the dome of the pivot. In some of these teachings, the contact pads extend toward the back end as they extend upward from the base. In some of these teachings, the inward protrusions above the contact pins continue into the backward extended area of the contact pad. This design facilitates retention of the rocker arm assembly on the pivot during a critical shift wherein the rocker arm may jump on the pivot and be displaced toward the back end. A contact pad that provides the surface in this backward area using a backward extending contact pad is more easily packaged as compared to the alternative of providing this backward area using a contact pad that is wider through the base.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1A:
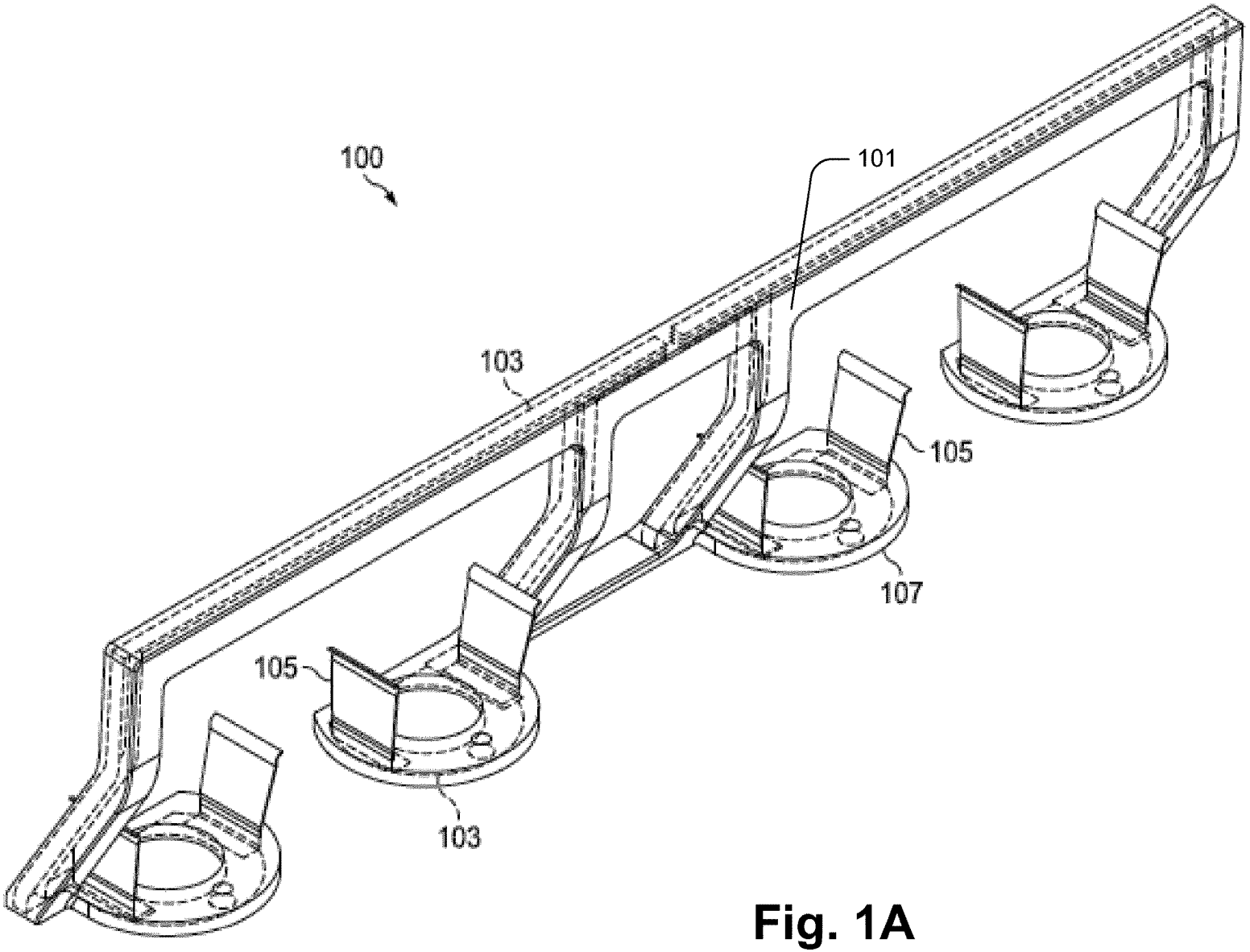
FIG. 1A provides a perspective view of a power transfer module according to some aspects of the present teachings.
Figure 1B:
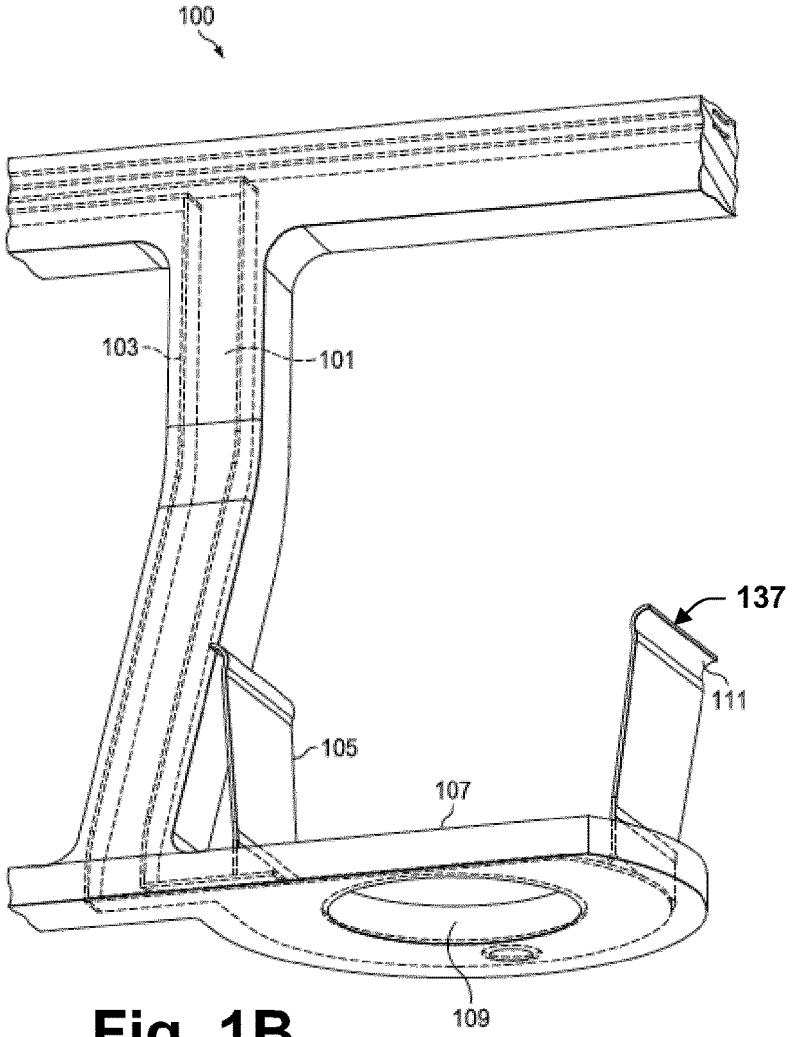
FIG. 1B provides another perspective view showing a portion of the power transfer module of FIG. 1A.
Figure 1C:
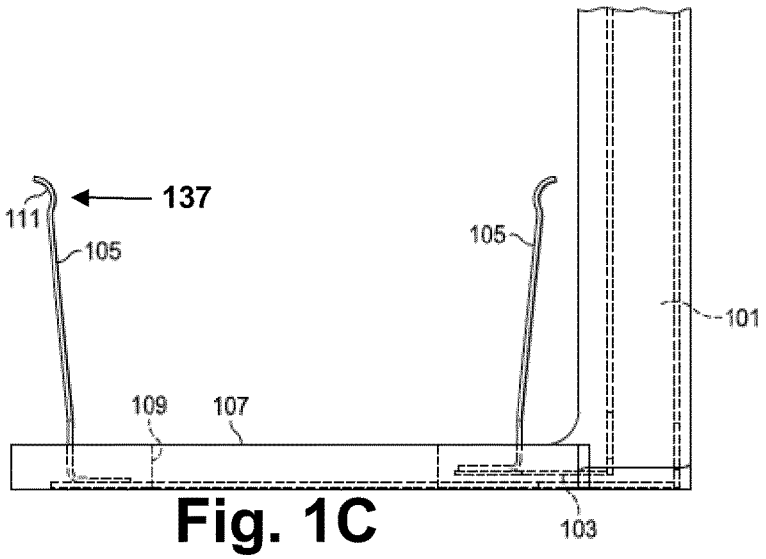
FIG. 1C provides a side view showing a portion of the power transfer module of FIG. 1A.

FIGS. 1A-1C provides several views of a power transfer module 100. Power transfer module 100 include a framework 101, wiring 103 in framework 101, and four pairs of contact pads 105 each extending upward from a base 107 of framework 101. As shown in FIG. 1A, the framework 101 including the four bases 107. Wiring 103 is contained in framework 101 making framework 101 a lead frame. Individual wires of wiring 103 couple to contact pads 105. The wires may terminate in a single connection plug (not shown).

FIG. 1B provides a bottom perspective view of a portion of framework 101 that includes one of the bases 107 and two associated contact pads 105. Circular openings 109 are formed in bases 107 allowing them to fit around pivots. Contact pads 105 are formed from sheet metal and are supported at one end by folds embedded in base 107. Upper ends 137 of contact pads 105 are unsupported and free floating. Contact pads 105 are short, rising 20 mm or less from base 107, in this example a distance in the range from 12-15 mm. Near their upper ends 137, contact pads 105 have inward facing rolls that form inward bends 111.

FIG. 1C provides a side view of a portion of framework 101 that includes one of the bases 107 and two associated contact pads 105. As best seen from this view, contact pads 105 generally have an outward taper. This taper is interrupted near the tops of contact pads 105 by inward bends 111. Inward bends 111 facilitate retention of a rocker arm assembly flanked by contact pads 105 on a pivot.

Figure 2:
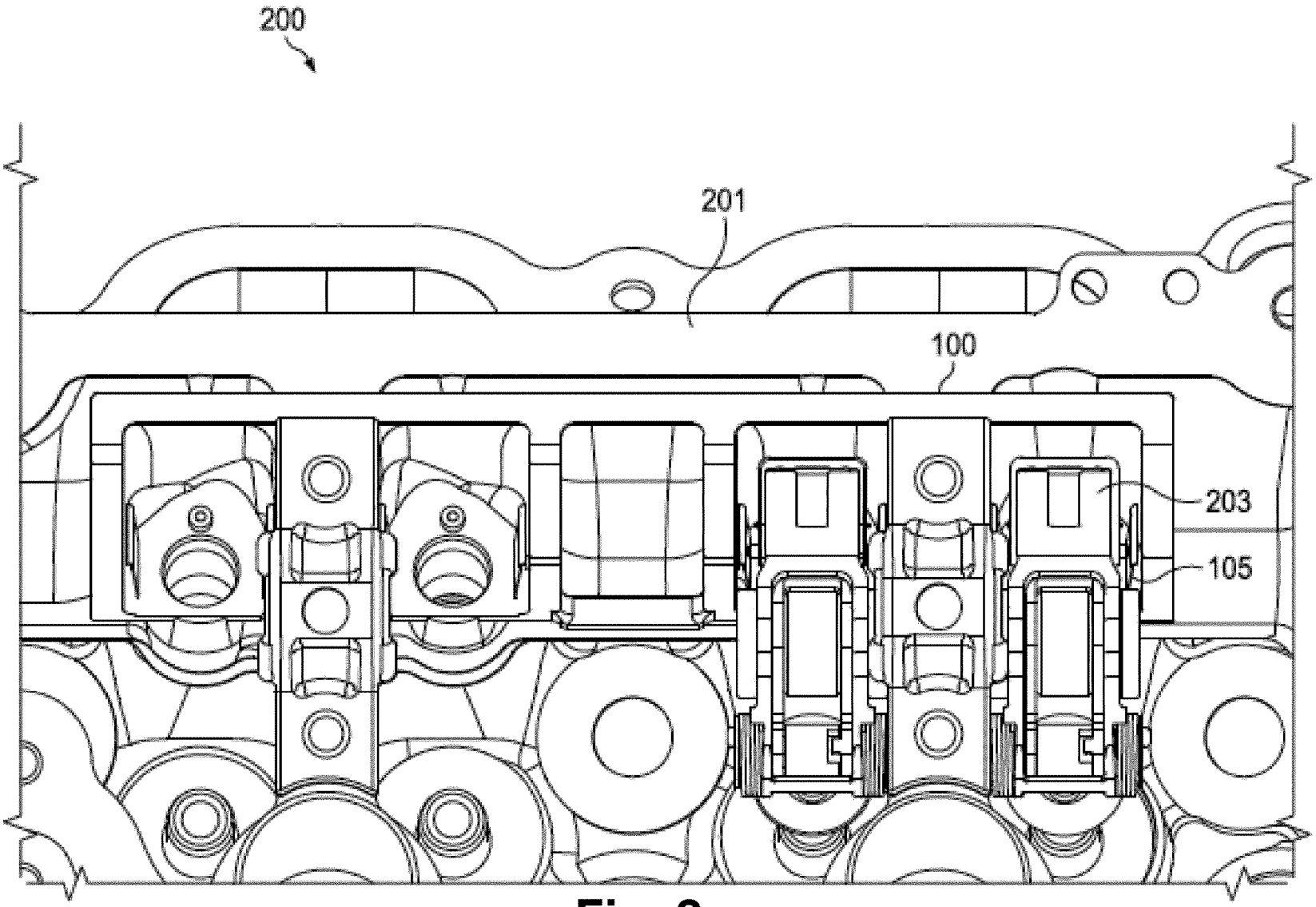
FIG. 2 provides a cutaway overhead view of an engine according to some aspects of the present teachings.

FIG. 2 provides a cutaway overhead view of an engine 200 including a cylinder head 201 on which power transfer module 100 has been installed. Installed in this manner, contact pads 105 are located to either side of rocker arm assemblies 203.

Figure 3:
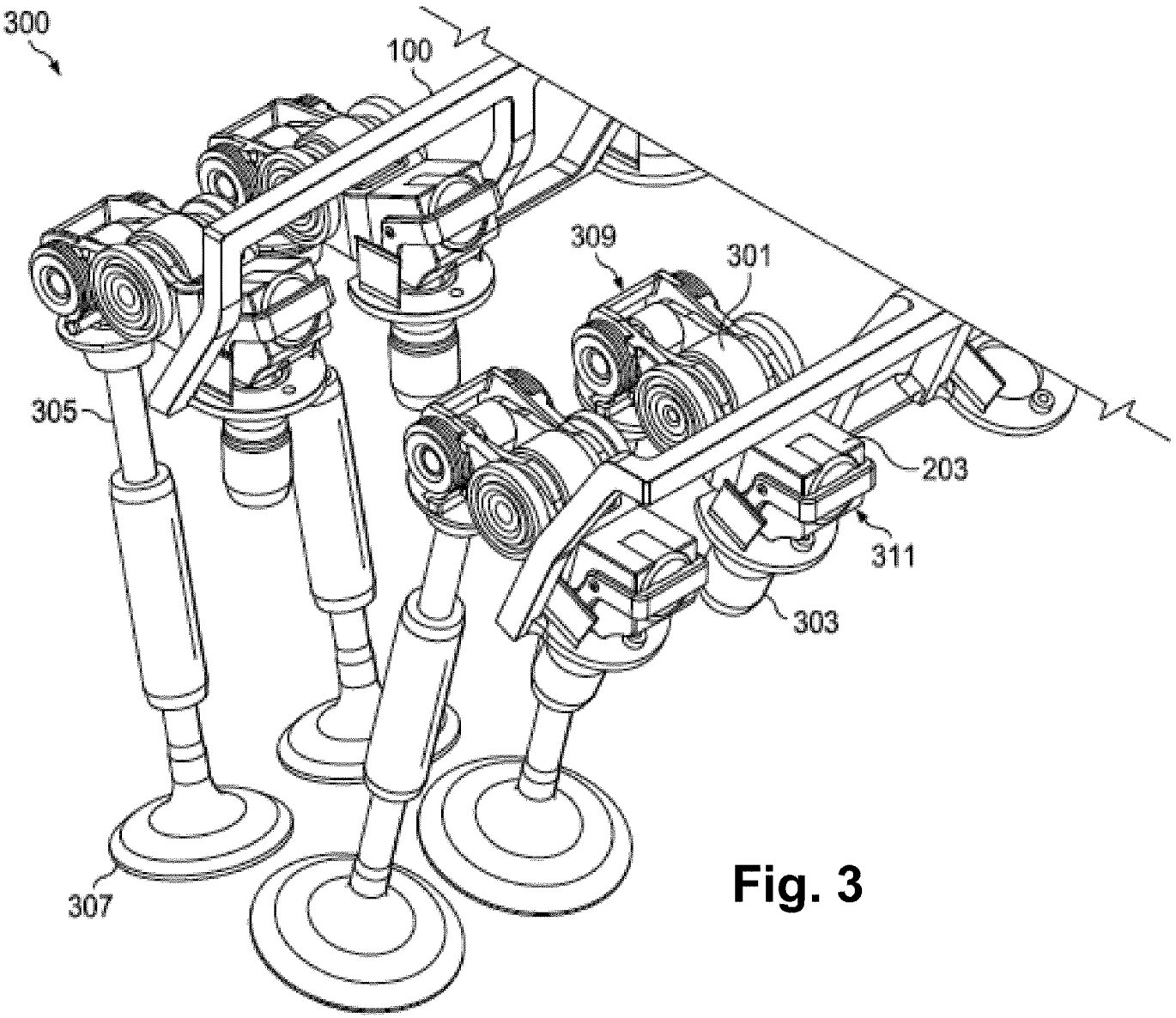
FIG. 3 provides a perspective view of a portion of a valvetrain according to some aspects of the present teachings.

FIG. 3 provides a perspective view of a portion of a valvetrain 300 including two power transfer modules 100 and four rocker arm assemblies 203. One of the power transfer modules 100 may be for a set of exhaust valves and the other power transfer modules 100 may be for a set of intake valves. Each rocker arm assembly 203 has a front end 309 proximate where the rocker arm assembly 203 contacts a valve stem 305 of a poppet valve 307 and a back end 311 proximate where the rocker arm assembly 203 rests on a pivot 303. Pivots 303 may be hydraulic lash adjusters that rise from bores in cylinder head 201. Each rocker arm assembly 203 includes a cam follower 301 for engaging a cam on a camshaft of valvetrain 300 (cams and camshafts shown in FIG. 5).

Figure 4:
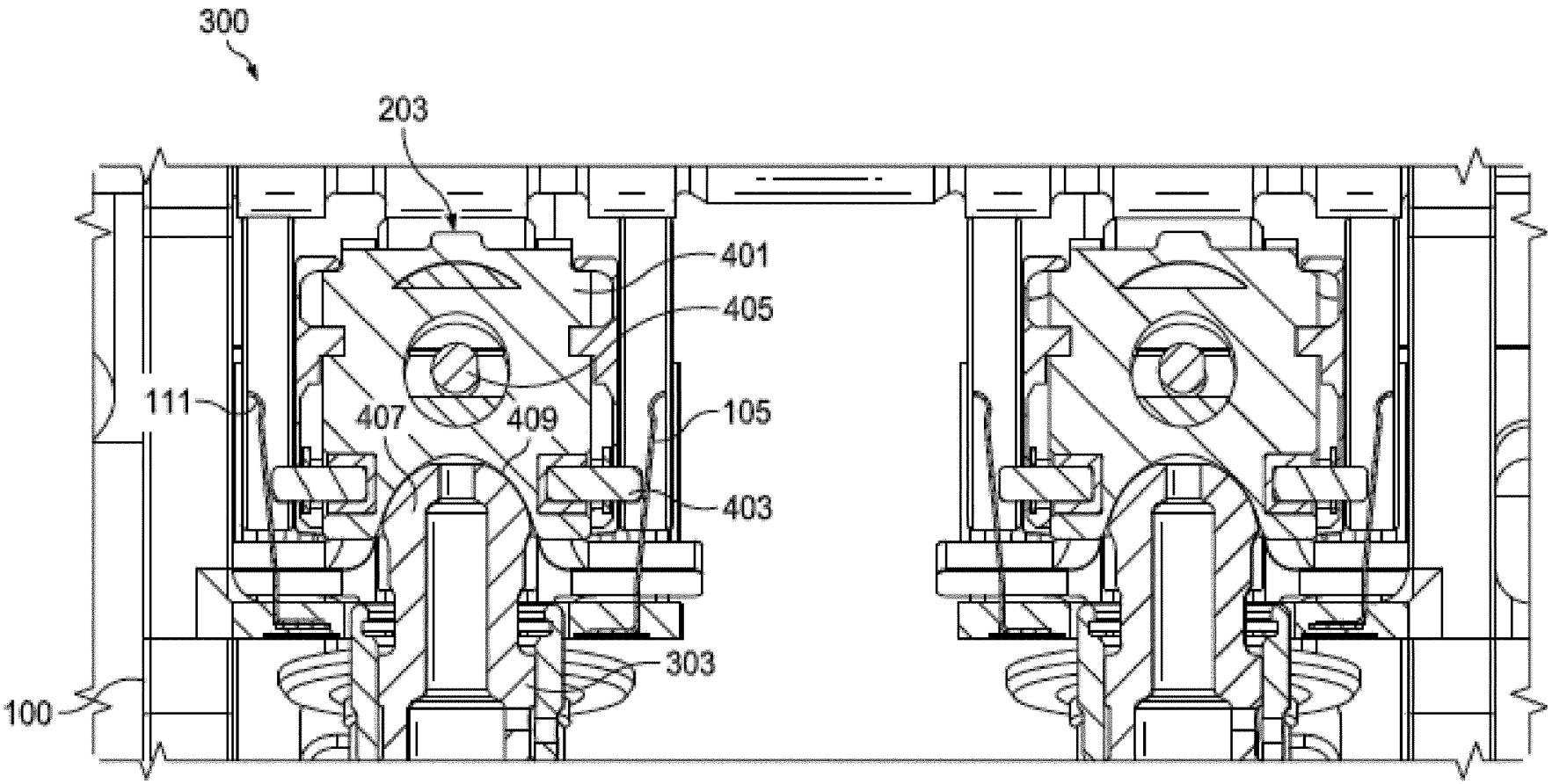
FIG. 4 provide a cross-sectional rear view of a portion of a valvetrain according to some aspects of the present teachings.

FIG. 4 provide a cross-sectional rear view of a portion of valvetrain 300 including a power transfer module 100, two pivots 303, and two rocker arm assemblies 203. A shown by this view, each rocker arm assembly 203 includes a rocker arm 401 having a latch pin 405 and two contact pins 403. Contact pins 403 may be piloted in holes on either side of rocker arm 401. Contact pins 403 may power an electromagnet (not shown) that is operative to actuate latch pin 405 between first and second positions. Placing latch pin 405 in the first position provides a configuration in which rocker arm assembly 203 is operative to actuate poppet valve 307 in response to rotation of the camshaft to produce a first valve lift profile. Placing latch pin 405 in the second position provides a configuration in which rocker arm assembly 203 is operative to actuate poppet valve 307 in response to rotation of the camshaft to produce a second valve lift profile, which is distinct from the first valve lift profile, or poppet valve 307 is deactivated. Latch pin 405 and the electromagnet are part of an electromagnetic latch assembly that effectuates this mode switching.

Rocker arm assemblies 203 may be installed on pivots 303 by pushing them downward until gothics 409 of rocker arms 401 contact domes 407 of pivots 303. This installation process may include deforming contact pads 105 outward to allow contact pins 403 to move past the inward facing rolls that form inward bends 111. After installation, contact pads 105 are resiliently biased against contact pins 403. If rocker arm assembly 203 begins to rise off pivot 303, contact pins 403 may encounter inward bends 111, which may then function to retain rocker arm assembly 203 on pivot 303.

Figure 5:
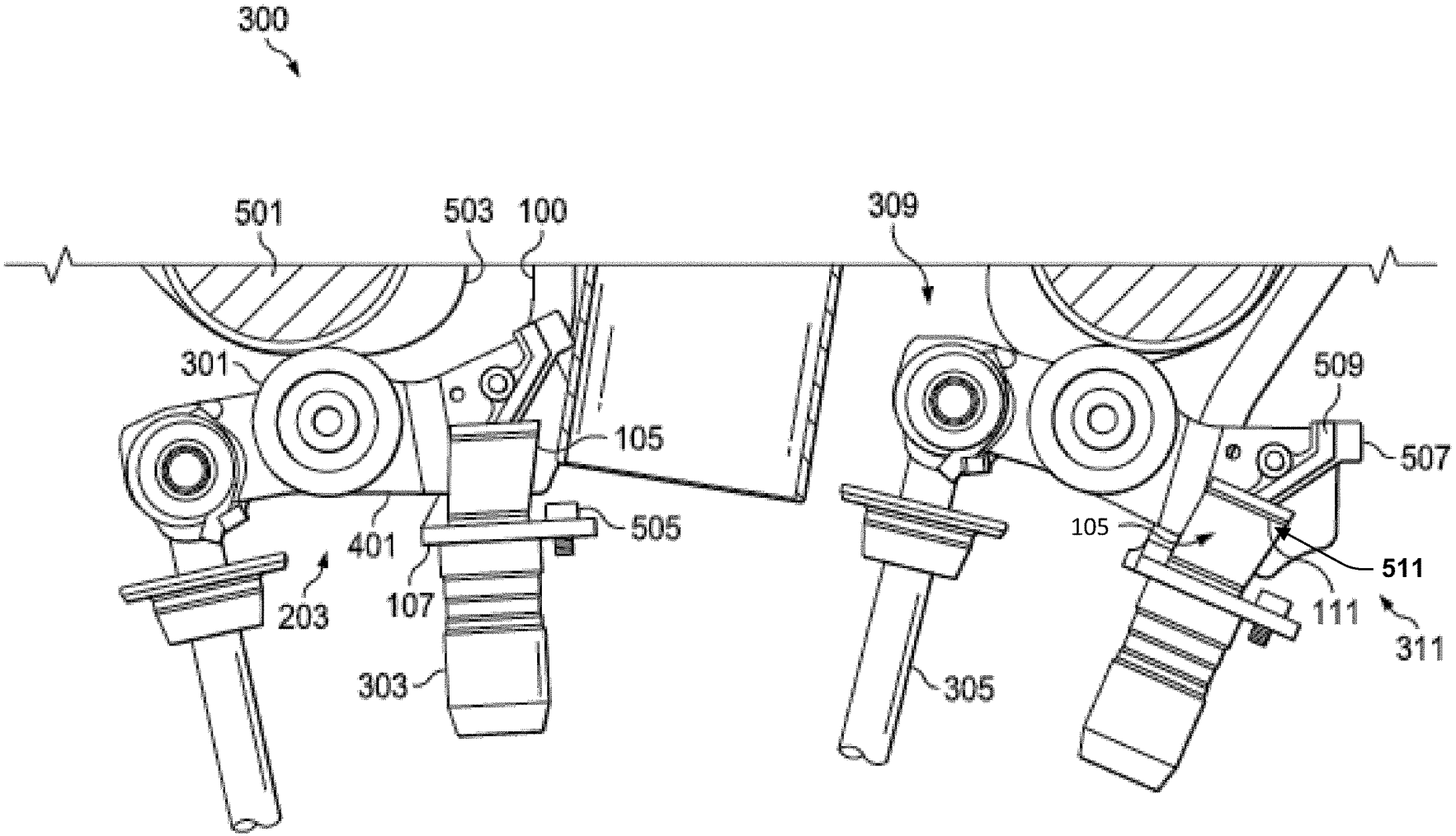
FIG. 5 provides a side view of a portion of a valvetrain according to some aspects of the present teachings.

FIG. 5 provides a side view of a portion of valvetrain 300 including camshafts 501 and cams 503. Cams 503 engage cam followers 301 as camshafts 501 rotate. Bases 107 of framework 101 rest on cylinder head 201 and may be attached to cylinder head 201 by bolts 505. Bases 107 abut and fit around pivots 303. Having bases 107 abut and/or go around pivots 303 helps located contact pads 105 relative to contact pins 403. In the present disclosure "fit around" means that after bases 107 are slid down onto pivots 303, bases 107 surround pivots 303 to a sufficient extent to restrict motion of bases 107 in any lateral direction.

FIG. 5 shows rocker arms 401 fit with contact frames 507. Contact frames 507 have conductors 509, which are leads that may couple contact pins 403 with poles of an electromagnet housed in rocker arm 401. FIG. 5 also show that contact pads 105 have a rearward taper. This rearward taper causes contact pads 105 to extend toward back end 311 as they extend upward from base 107 of power transfer module 100. The rearward taper allows inward bends 111 to extend into a rearward area 511. During a critical shift, a rocker arm assembly 203 may shift rearward and upward to the point that contact pins 403 encounter inward bends 111 in rearward area 511, at which point inward bends 111 may restrain the rocker arm assembly 203 and allow it to return to its normal position on pivot 303. A critical shift is an event in which latch pin 405 slips out of engagement while rocker arm 401 is on lift, which results in rocker arm 401 moving with abnormal speed.

Figure 6:
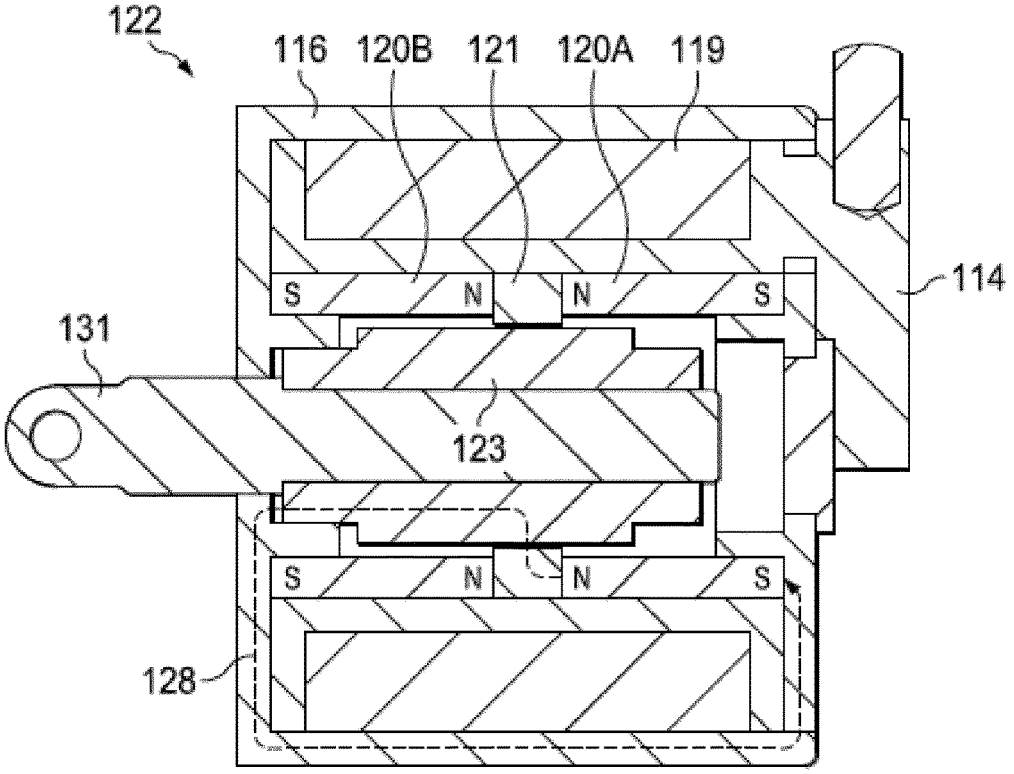
FIG. 6 is a cross-sectional view of an electromagnetic latch assembly according to some aspects of the present teachings with its plunger in an extended position.
Figure 7:
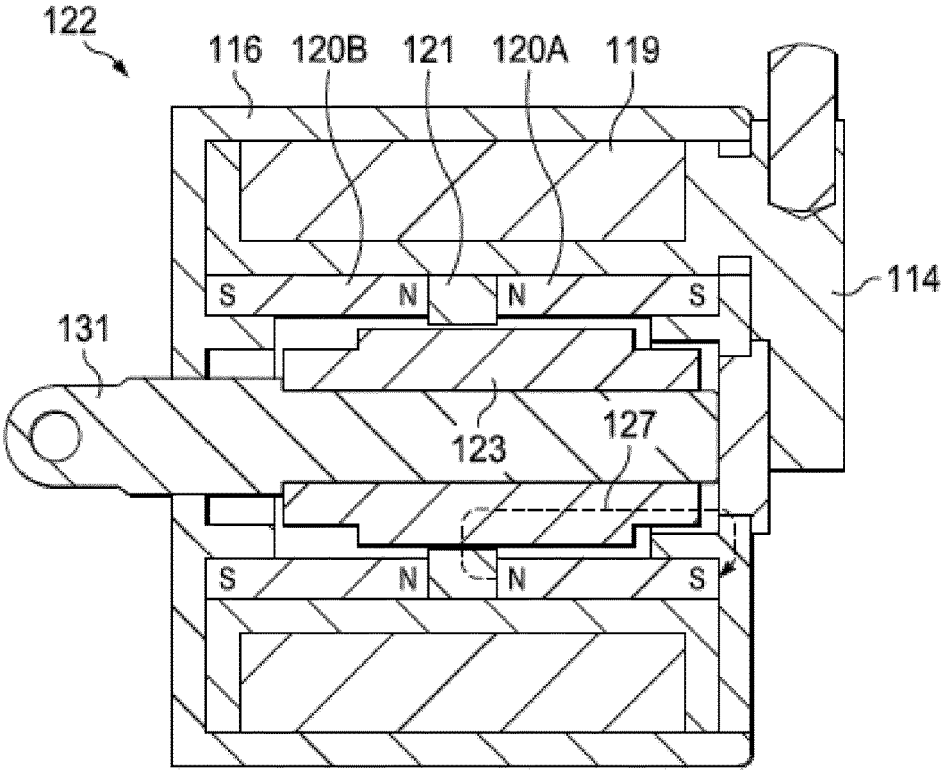
FIG. 7 is the view of FIG. 6 with the plunger in a retracted position.

FIG. 6 shows an electromagnetic latch assembly 122 having a plunger 131 in an extended position. FIG. 7 shows the electromagnetic latch assembly 122 with the plunger 131 in a retracted position. Permanent magnets 120 operate on the plunger 131 through low coercivity ferromagnetic ferule 123. As illustrated by FIGS. 6 and 7, the magnetic circuits taken by flux from permanent magnets 120 varies as plunger 131 moves between the first and second positions. In the first position, the flux from permanent magnet 120A follows magnetic circuit 128 (see FIG. 6) which includes ring 121 and ferule 123 and goes around electromagnet 119 through shell 116. In the second position, the flux from permanent magnet 120A follows magnetic circuit 127 (see FIG. 7), which also includes ring 121 and ferule 123 but only a small portion of shell 116. Magnetic circuit 127 is a very tight magnetic circuit with a low flux leakage.

Electromagnet 119 is operable to alter magnetic polarizations in the magnetic circuits taken by flux from permanent magnets 120. Energized with current in a first direction, electromagnet 119 is operable to cause plunger 131 to translate from the first position to the second position. Once plunger 131 is in the second position, permanent magnets 120 will stably maintain plunger 131 in the second position after power to electromagnet 119 is cut off. Energized with current in a second direction, which is the reverse of the first, electromagnet 119 is operable to cause plunger 131 to translate from the second position back to the first position. Once plunger 131 is in the first position, permanent magnets 120 will stably maintain plunger 131 in the first position after power to electromagnet 119 is again cut off.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber and a moveable valve having a seat formed in the combustion chamber, comprising:

a camshaft;

a pivot including a dome portion;

a rocker arm assembly mounted on the pivot and comprising a rocker arm having a gothic, a cam follower configured to engage a cam mounted on the camshaft as the camshaft rotates, and two contact pins protruding to opposite sides of the rocker arm assembly;

an electromagnetic latch assembly comprising a latch pin and an electromagnet powered through at least one of the contact pins, wherein the electromagnet is operable to move the latch pin between a first latch pin position and a second latch pin position;

a power transfer module comprising a framework; and two contact pads each contacting a respective one of the contact pins and having inward facing rolls that form inward bends to facilitate retention of the rocker arm assembly on the pivot, wherein the contact pads are deformed outward to allow the contact pins to move past the inward bends when the rocker arm assembly is pushed downward until the gothic of the rocker arm contacts the dome portion of the pivot.

2. The valvetrain of claim 1, wherein the inward bends are integral with the inward facing rolls in the contact pads.

3. The valvetrain of claim 1, wherein the electromagnetic latch assembly provides the latch pin with positional stability that is independent of the electromagnet when the latch pin is in the first latch pin position and the second latch pin position, wherein the electromagnetic latch assembly stabilizes the latch pin without power in both the first and the second latch pin positions allowing an electrical connection to be broken without changing a position of the latch pin, and allowing operation of the electromagnet to be restricted to times at which the cam is on a base circle and the contact pins are stationary relative to the contact pads.

4. The valvetrain of claim 1, further comprising:

wiring that connects with the contact pads;

wherein the framework becomes a lead frame for the wiring that is contained in the framework.

5. The valvetrain of claim 1, wherein:

the pivot is one of a plurality of pivots; and the framework surrounds two or more of the plurality of pivots.

6. A method of assembling the valvetrain of claim 1, the method comprising bending the contact pads outward sufficiently to push the contact pins past the inward bends when the rocker arm assembly is pushed.

7. The method of claim 6, further comprising fitting the framework around the pivot.

8. A valvetrain for an internal combustion engine of a type that has a combustion chamber and a moveable valve having a seat formed in the combustion chamber, comprising:

a camshaft;

a pivot;

a rocker arm assembly mounted on the pivot and comprising a rocker arm, a cam follower configured to engage a cam mounted on the camshaft as the camshaft rotates, and two contact pins protruding to opposite sides of the rocker arm assembly;

an electromagnetic latch assembly comprising a latch pin and an electromagnet powered through at least one of the contact pins, wherein the electromagnet is operable to move the latch pin between a first latch pin position and a second latch pin position;

a power transfer module comprising a framework that has a base that abuts the pivot; and two contact pads that extend upward from the base and terminate with free floating upper ends, wherein the two contact pads respectively abut tips of the two contact pins to form an electrical circuit, wherein the two contact pins respectively bias the two contact pads outwardly along the longitudinal axes of the two contact pins.

9. The valvetrain of claim 8, wherein the base fits around the pivot.

10. The valvetrain of claim 8, wherein the electromagnetic latch assembly comprises a permanent magnet operative to stabilize the latch pin in both in the first latch pin position and in the second latch pin position.

11. The valvetrain of claim 8, wherein the contact pads extend upward from the base by 20 mm or less.

12. The valvetrain of claim 11, wherein the contact pads each has an inward bend in an area above the contact pins.

13. The valvetrain of claim 11, wherein:

the rocker arm assembly has a front end and a back end;

the rocker arm assembly abuts a valve stem proximate the front end and rests on the pivot proximate the back end; and the contact pads extend toward the back end as they extend upward from the base.

14. The valvetrain of claim 8, wherein the contact pads angle outward from the rocker arm assembly as they extend upward from the base.

15. The valvetrain of claim 14, wherein the contact pads each have protrusions in an area above the contact pins to improve retention of the rocker arm assembly on the pivot.

16. The valvetrain of claim 15, wherein:

the protrusions of the contact pads comprise an inward bulge in an area that is above the contact pins and includes an area further toward a back end of the contact pins; and the inward bulge is functional to facilitate the retention of the rocker arm assembly on the pivot during a critical shift.

17. The valvetrain of claim 14, wherein:

the rocker arm assembly has a front end and a back end;

the rocker arm assembly abuts a valve stem proximate the front end and rests on the pivot proximate the back end; and the contact pads extend toward the back end as they extend upward from the base.

18. The valvetrain of claim 8, wherein the contact pads each have protrusions in an area above the contact pins to improve retention of the rocker arm assembly on the pivot.

19. The valvetrain of claim 18, wherein:

the protrusions of the contact pads comprise an inward bulge in an area that is above the contact pins and includes an area further toward a back end of the contact pins; and the inward bulge is functional to facilitate the retention of the rocker arm assembly on the pivot during a critical shift.

20. The valvetrain of claim 8, wherein:

the rocker arm assembly has a front end and a back end;

the rocker arm assembly abuts a valve stem proximate the front end and rests on the pivot proximate the back end; and the contact pads extend toward the back end as they extend upward from the base.

* * * * *